US012655588B2

(12) United States Patent
Leppaenen

(10) Patent No.: US 12,655,588 B2
(45) Date of Patent: Jun. 16, 2026

(54) FOUNDATION, APPARATUS AND METHOD FOR PRODUCING THE SAME

(71) Applicant: Betolar Oy, Kannonkoski (FI)

(72) Inventor: Juha Leppaenen, Kannonkoski (FI)

(73) Assignee: BETOLAR OY, Kannonkoski (FI)

( * ) Notice: Subject to any disclaimer, the term of this patent is extended or adjusted under 35 U.S.C. 154(b) by 756 days.

(21) Appl. No.: 18/004,645

(22) PCT Filed: Jul. 6, 2021

(86) PCT No.: PCT/FI2021/050523
§ 371 (c)(1),
(2) Date: Jan. 6, 2023

(87) PCT Pub. No.: WO2022/008799
PCT Pub. Date: Jan. 13, 2022

(65) Prior Publication Data

US 2023/0279619 A1 Sep. 7, 2023

(30) Foreign Application Priority Data

Jul. 9, 2020 (FI) ..... 20205743

(51) Int. Cl.
*E01C 21/00* (2006.01)
*E01C 3/04* (2006.01)
*E01C 23/01* (2006.01)

(52) U.S. Cl.
CPC ..... *E01C 21/00* (2013.01); *E01C 3/04* (2013.01); *E01C 23/01* (2013.01); *E01C 2201/04* (2013.01)

(58) Field of Classification Search
CPC . E01C 3/04; E01C 21/00; E01C 23/01; E01C 23/10; E01C 2201/04; E02D 3/12
See application file for complete search history.

(56) References Cited

U.S. PATENT DOCUMENTS 1,705,066 A * 3/1929 Sadtler ..... E01C 3/04 404/72
3,656,690 A 4/1972 Hanig
3,839,518 A 10/1974 Rubens et al.
4,024,719 A * 5/1977 Risseeuw ..... E02D 17/18 405/232
4,679,731 A 7/1987 Klugar et al.
(Continued)

FOREIGN PATENT DOCUMENTS

CA 2930656 C * 8/2020 ..... C04B 28/008
GB 515153 A * 11/1939 ..... E01C 19/002
(Continued)

OTHER PUBLICATIONS

ISA Finnish Patent and Registration Office, International Search Report Issued in Application No. PCT/FI2021/050523, Sep. 28, 2021, WIPO, 3 pages.

*Primary Examiner* — Abigail A Risic
(74) *Attorney, Agent, or Firm* — McCoy Russell LLP

(57) ABSTRACT

Foundation, apparatus and method for stabilization of a foundation. The foundation comprises a subsoil and a pavement structure formed over it, which pavement structure includes a plurality of successive structural layers. At least one of these structural layers is a binder-stabilized structural layer which includes stone material and a binder. Additionally, the stabilized structural layer is enclosed within a sleeve structure.

27 Claims, 6 Drawing Sheets

(56) References Cited

U.S. PATENT DOCUMENTS

Figure 1:
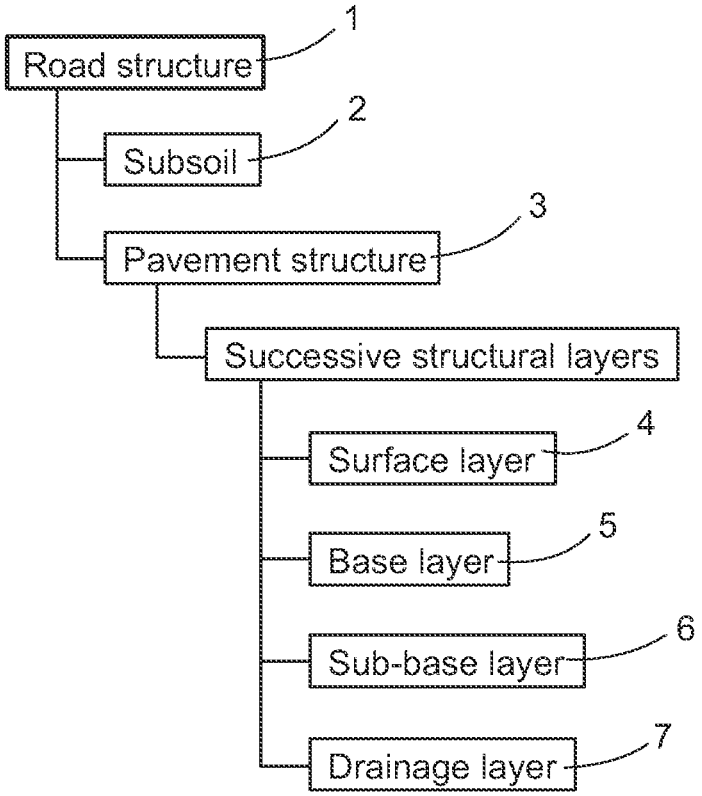

| | | | | |
|---|---|---|---|---|
| 9,828,740 | B1 * | 11/2017 | Brown | E02D 31/14 |
| 2018/0100282 | A1 * | 4/2018 | Vuyk, Jr. | E02D 27/08 |
| 2022/0049450 | A1 * | 2/2022 | Lewis | E02D 31/006 |

FOREIGN PATENT DOCUMENTS

| | | | | | |
|---|---|---|---|---|---|
| GB | 525699 | A | | 9/1940 | |
| GB | 2495591 | A | * | 4/2013 | E01C 5/065 |
| SU | 1044720 | A1 | | 9/1983 | |
| WO | WO-2004005621 | A1 | * | 1/2004 | E01C 3/003 |

* cited by examiner

FOUNDATION, APPARATUS AND METHOD FOR PRODUCING THE SAME

CROSS REFERENCE TO RELATED APPLICATIONS

The present application is a U.S. National Phase of International Application No. PCT/FI2021/050523 entitled "FOUNDATION, APPARATUS AND METHOD FOR PRODUCING THE SAME," and filed on Jul. 6, 2021. International Application No. PCT/FI2021/050523 claims priority to Finland Patent Application No. 20205743 filed on Jul. 9, 2020. The entire contents of each of the above-listed applications are hereby incorporated by reference for all purposes.

BACKGROUND OF THE INVENTION

The invention relates to a new solution for utilization and treatment of hardenable materials and masses.

More specifically, the invention relates to the use of stabilizing materials in foundations and to an apparatus and a method intended for this purpose.

The object of the invention is described in more detail in the preambles of independent claims of the application.

The length of the whole road network in Finland is approximately 454 000 kilometres. The road network consists of state-owned roads, streets maintained by municipalities and privately maintained private roads. The roads are classified according to their importance as class I main roads, class II main roads, regional roads and connecting roads. Finland is a sparsely populated country with long geographical distances to municipal centres. Funding for maintenance of the general road network has been cut down, whereby the main emphasis of road maintenance has had to be focused on developing the main road network. This has led to deterioration of the condition of the lower-grade road network. The challenges in road network maintenance include, in addition to the reduced funding, an increasing traffic load exerted on the road structure and availability of good-quality stone material. In cold northern conditions a determining factor in the total thickness of the road pavement structure is often the frost heave. However, in old lower-grade roads the structural layers are relatively thin and partly blended with the soil. In these types of roads there commonly occurs softening, which is a result of repeated freezing and melting cycles, whereby the fine material is blended with a structural layer and the structural layer sinks into the soil. As thick structural layers require much material and consume natural resources, the problems related to the bearing capacity and frost heaving of the lower-grade roads have been attempted to be solved by stabilization. Cement has traditionally been used as a stabilizing binder when improving the bearing capacity of gravel roads. In the current road repair solutions, several defects have been observed.

SHORT DESCRIPTION OF THE INVENTION

The idea of the invention is to provide a new and improved foundation and further a new and improved apparatus and method for the use of stabilizing materials in road and earth construction.

The characteristic features of the foundation according to the invention are disclosed in the characterizing part of the first independent claim.

The characteristic features of the apparatus according to the invention are disclosed in the characterizing part of the second independent claim.

The characteristic features of the method according to the invention are disclosed in the characterizing part of the third independent claim.

The idea of the proposed solution is the use of side-stream materials in road construction. Thereby the road structure is treated with one or more hardenable binders to improve its compression strength. Additionally, said stabilized structural layer of the road structure is arranged in a space delimited by a sleeve structure. This way it is possible to form a road structure which comprises subsoil and a pavement structure formed over the subsoil, and which includes a plurality of successive structural layers. One or more of said structural layers are stabilized by means of at least one hardenable binder so as to form a binder-stabilization layer in the foundation. Additionally, one or more of said binder-stabilization layers of the pavement structure are arranged to be enclosed within the sleeve structure.

One advantage of the proposed solution is that the sleeve structure may protect the stabilized structural layer and thereby enable the use of different binders and binder mixtures made from side-streams and wastes in road structures. The life-cycle costs of pavement structures containing base layers stabilized with such binders and their mixtures produced from side-stream materials or wastes may be significantly lower as compared to pavement structures constructed from natural stone materials.

Further, one advantage of the proposed sleeve or shell structure is that the sleeve holds the binder-stabilized mass in a limited space and may give a desired shape for the structure. The sleeve may thus function as a type of mould or container. Many binder-stabilized masses will harden for a long time, whereby the sleeve structure may ensure that the structure maintains its desired shape also before complete hardening. The sleeve also facilitates handling of the hardening mass and its installation in the road structure.

One further advantage of the proposed sleeve or shell structure is that the sleeve structure protects the binder-stabilized structure against external moisture. The upper part of the sleeve may guide the waters away from the structure. The base part may prevent the water from rising through capillary action from soil foundation into the structure. The sleeve may thus prevent the access of water from outside into the structure, but it may prevent the passage of fluids also in the other direction, i.e. from the stabilized structure towards the surroundings. This way it may be ensured that environmentally harmful materials are not dissolved from the binder-stabilized structure and released to the environment. Thus, due to the sleeve structure, it is possible to use and apply also materials and material mixtures in road structures that were earlier not allowed to be used.

A further advantage of the proposed new solution may be that difficultly treatable side-stream materials may be efficiently and safely processed and utilized at a road and earth construction site. In the method, the mass may be prepared at a construction site in one operation into a ready castable batch and applied to the road or foundation pavement structure together with the sleeve.

Although it is disclosed above that the solution is applicable to the renovation and construction of lower-class and gravel roads, it may equally well be also applied in the renovation and foundation of main roads and other larger roads.

It is to note that in this application a geopolymer may also mean an alkali-activated material. In this type of material, silicon oxide $SiO_2$ and aluminium oxide $Al_2O_3$ have reacted and formed a compression-resistant solid structure. Sometimes geopolymers are also referred to in literature as a subset of alkali-activated materials. In this type of material, silicon oxide $SiO_2$ and aluminium oxide $Al_2O_3$ have a central role in the formation of so-called geopolymer cement which is a cement-like binder. Geopolymer cement may be utilized in the manufacture of a compression-resistant, concrete-like material.

Further, it may be stated that a geopolymer is a cementitious binder which may be utilized for the manufacture of a concrete-like material, and which is produced from a silicon- and aluminium-containing material, for example a side-stream material in alkaline or acidic conditions. A concrete-like strong material produced in a reaction of industrial mineral side-streams and alkaline components is also generally called a geopolymer. Alkaline components such as sodium-based solutions are used as reactive agents in the manufacture.

The idea of one embodiment is that material treated with a stabilizing binder is applied into a sleeve structure or into a space delimited by a sleeve structure, whereby the sleeve structure forms the outer surface of a structural layer. Because the sleeve structure delimits the reinforced structural layer already before consolidation, the sleeve structure may also be called a type of casting mould into which the hardenable mass is fed, cast or applied in another way. The feeding of mass may also be carried out by means of an excavator or by tipping from a transport vehicle, a mixer or a specific movable work machine or apparatus.

The idea of one embodiment is that said binder-stabilization layer is formed in-situ at a road site, road construction site or corresponding work site.

According to one embodiment the binder-stabilization layer stabilized inside a sleeve structure is formed by continuous casting, whereby it forms a continuous reinforced beam. In the context of a road structure, this beam extends in a longitudinal direction of the road. In other applications the orientation may be selected according to the shape of the foundation and the forces exerted on the foundation.

According to one embodiment, binder-stabilization layers stabilized inside a sleeve structure are formed as a plurality of successive beams of a predetermined length extending in a longitudinal direction of the road structure or the foundation, whereby said beams form successive bridge beams in the road structure or the foundation in a longitudinal direction of the road or the foundation.

According to one embodiment, the solution described in this document may be applied in both of constructing a new road and renovating and improving the capacity of an old road.

According to one embodiment, the solution described in this document may be applied to the renovation of an old road structure by stabilizing the road structure without adding any new stone material.

According to one embodiment, the solution described in this document may be applied in the structures of roads, motorways, streets, footways, cycleways, competition tracks, runways and other ways.

According to one embodiment, the solution described in this document may be applied in the road structures of trains and tramways, i.e. in the load-bearing structures of railways.

According to one embodiment, a road pavement structure comprises: a sub-base layer; a base layer; a drainage layer and a surface. Among the layers of the road pavement structure, the sub-base layer, base layer or upper part of the base layer may be stabilized. The stabilization is performed by means of a consolidating binder being mixed into the stone material of the structural layer and as described in this document in a space delimited by a sleeve structure.

According to one embodiment, the road pavement structure comprises a binder-stabilized base layer. Over the base layer arranged inside a sleeve structure there is a crushed-material layer which protects the stabilized structure and by means of which the upper surface of the road structure may be shaped as desired. Crushed material may also function as a drainage layer.

According to one embodiment, the binder-stabilization layer arranged inside a sleeve structure comprises stone material and at least one hardenable binder.

According to one embodiment, said stone material is the existing stone material in the road structure being stabilized.

According to one embodiment, the stone material is any stone material in the vicinity of the road. Due to the stabilization treatment, lower-quality stone material is also suitable for the purpose.

According to one embodiment, crushed material formed from industrial side-stream material is used instead of natural stone material.

According to one embodiment, the binder-stabilization layer arranged inside a sleeve structure is of a geopolymer or an alkali-activatable hardenable mixture.

According to one embodiment, the binder-stabilization layer arranged inside a sleeve structure comprises at least one fibre reinforcement.

According to one embodiment, said fibre reinforcement is staple fibre.

According to one embodiment, said fibre reinforcement is recycled fibre.

According to one embodiment, the fibre reinforcement is cellulose-based fibre. In this case the fibre comprises lignin.

According to one embodiment, the fibre reinforcement is textile fibre. The textile fibre may be recycled fibre, such as modified fibre from cast-off clothes or other textiles. The recycled fibre may also have been prepared from surplus clothes or surplus material of textile industry processes. Textile fibre has been found to be particularly well suited for reinforcing at least foundation structures of which the required lifetime is limited. Such structures include for example various temporary roads, support structures and protective embankments.

According to one embodiment, the fibre reinforcement is waste fibre being produced in the demolition of wind turbines. The blades and also other structures of wind turbines include reinforced plastic in which the plastic material is reinforced with glass fibres, carbon fibres or the like. Especially the dismantling of the blades produces a large amount of glass-fibre plastic waste which after crushing may be used as such as a filler in a foundation. Further, the glass-fibre plastic waste may be processed in such a way that mainly just the fibre material is used as fibre reinforcement in the foundation. The wind turbine demolition waste may be used for extension and repair construction of the surroundings of the wind turbine being demolished and of the wind park, whereby the waste need not be transported over long distances. In other words, for example foundations of new wind turbines and service roads may be constructed from the proposed solution. It is also possible to use the proposed solution in the construction and renovation of the road network and other foundation work in the surrounding area. The treatment of the wind turbine blades may comprise crushing by a movable crushing device in the immediate vicinity of the wind turbine being demolished.

According to one embodiment, the compression strength of the binder-stabilization layer arranged inside a sleeve structure is at least 0.1 Mpa.

According to one embodiment, said compression strength is 0.1-100 Mpa.

According to one embodiment, said compression strength is at least 4 Mpa.

According to one embodiment, the compression strength is at least 20 Mpa.

According to one embodiment, the binder-stabilization layer arranged inside a sleeve structure is foamed. By means of foaming, a light-weight yet strong material is obtainable. Such foamed porous-structure foamy material may have a good thermal insulation capacity.

According to one embodiment, the foamed structural layer is arranged to function as a thermally insulating layer in the road structure. Thereby the frost protection of the road structure and the foundation may be improved. Further, an advantage is that the road structure may have a reduced thickness when the frost protection need no longer be based on thick material layers.

According to one embodiment, the foamed structural layer is arranged to absorb and reduce vibrations and noise. A road or foundation provided with such structural layer is thus well-suited for use for example in the vicinity of population centres.

According to one embodiment, the foaming may improve toughness of the structural layer and thereby increase lifetime of the structure in varying conditions.

According to one embodiment, the foaming reduces density of the structural layer, whereby it is possible to make a layer having an increased material thickness without increasing the weight of the road structure or the foundation. It is possible to use such foamed lightening structure or one or more foamed lightened structural layers for raising the road line or for passing over depressions and dips. In other words, such lightening structure makes the construction of a road and other foundations easier, quicker and less expensive in an uneven terrain.

According to one embodiment, the foamed structural layer further comprises one or more fibre reinforcements. Such structure may have a particularly high strength and toughness in relation to its weight.

The idea of one embodiment is that the foaming may be carried out chemically, for example by adding hydrogen peroxide, soap, saponin or sodium perborate to a mass comprising industrial side-stream material. Alternatively, the foaming may be performed mechanically by using a foaming apparatus that may substantially correspond to an apparatus intended for the foaming of concrete.

According to one embodiment, the binder-stabilization layer arranged inside a sleeve structure further comprises at least one filler which is non-stone material.

According to one embodiment, said filler is rubber, shredded vehicle tires, shredded plastic, pulp-based material, processed green liquor dregs, plaster, slag or combustion ash.

According to one embodiment, said filler is mixed into the hardenable mass.

According to one embodiment, said filler is arranged to form one or more continuous filler portions or volumes in a binder-stabilization layer, which are arranged to form a composite structure together with the hardenable mass. The structure may thus comprise a filler core enclosed within the hardenable mixture, or alternatively, the structure may comprise a honeycomb structure including filler cells that are delimited by walls being formed of the hardenable mixture. The filler may be free, without a binder, in said core or cell, or it may be bound with one or more binders. The filler may lighten the composite structure and it may also function as a thermal insulator and as a vibration-damping element. It is also possible that a filler core or a filler cell functions as a heat or electricity-storing element in the structure.

According to one embodiment, the binder-stabilization layer arranged inside a sleeve structure further comprises at least one stiffener element.

According to one embodiment, said stiffener element is of metal. The stiffener element may be for example steel, stainless steel or acid-proof steel. If the binder mixture is of a geopolymer or an alkali-activatable hardenale mass, it is basic, whereby the hardenable mixture protects steel reinforcements against corrosion.

According to one embodiment said stiffener element is a geosynthetic reinforcement, such as a bar, profile or meshwork. In this case, one or more of the geosynthetic reinforcement elements are arranged inside a sleeve structure together with the binder-hardenable material.

According to one embodiment, said stiffener element is fibre material. The fibres may be plastic material, glass fibre, aramid fibre or some other polymeric material. Alternatively, the stiffener may be a structure formed of natural fibres or recycled fibres.

According to one embodiment, said stiffener element is a meshwork.

According to one embodiment, said stiffener element is a mat or a fabric.

According to one embodiment, said stiffener element is a wire, rope or braid.

According to one embodiment, said stiffener element is a grid, shaper plate, profiled ribbon, hoop, corrugated plate, bar.

According to one embodiment, the sleeve structure is flexible film-like material.

According to one embodiment, the sleeve structure is plastic material. Alternatively it is of rubber or a rubber mixture.

According to one embodiment, the sleeve structure may be of a film-like solid material or membrane. Alternatively, it may be a structure woven or coiled from threads.

According to one embodiment, the sleeve structure is at least mainly fibre material.

According to one embodiment, the sleeve structure is at least mainly natural fibre material.

According to one embodiment, the sleeve structure is pulp-based fibre material. The sleeve may be formed from cellulose comprising wood fibre.

According to one embodiment, the sleeve structure is recycled fibre, such as textile fibre.

According to one embodiment, the sleeve structure is treated with at least one sealing material at least from its inner surface. Said sealing material may be one or more of the following: bentonite, wax, fibre and deinking suspension fibre clay, bakelite, plastic. Alternatively, some of the above-mentioned materials are arranged between the sleeve structure and the structure of hardenable mass as a separate sealing layer.

According to one embodiment, the thickness of the material of the sleeve structure is 1-10 mm, typically 2-5 mm.

According to one embodiment, the sleeve is impermeable to liquid and solid material. Thereby no external materials are able to access into or out of the sleeve.

According to one embodiment, the sleeve is of a material allowing a gas to pass from the inside to the outside. Thereby the gases possibly arising from the stabilized mass are able to escape from the structure.

According to one embodiment, the sleeve is of a material permeable to water vapor. Thereby the water vapor being formed in the drying and hardening of the stabilized mass is able to escape through the sleeve.

According to one embodiment, at least the upper surface of the sleeve structure has at least one portion permeable to gas. The water vapor possibly being formed in the stabilized mass or other gases rise up, whereby it may be sufficient to provide an exit for the gases only at the upper surface of the sleeve structure.

According to one embodiment, the sleeve is a semi-permeable film. A semi-permeable film is a thin film that allows only molecules or ions having a specific size or charge to diffuse through. Typically, semi-permeable films have very small holes from which small molecules such as water are able to pass through the film. Excessively large compounds or ions with the wrong type of charge are not able to pass through the semi-permeable film.

According to one embodiment, the sleeve comprises a passageway for the water vapor being formed in the hardening of the hardenable mixture to be discharged from inside the sleeve.

According to one embodiment, the sleeve structure is formed of a material which is impermeable to solid material and liquid.

According to one embodiment, the sleeve structure is formed of a material which is permeable to solid material and liquid, but which has been treated to become impermeable to solid material and liquid.

According to one embodiment, the sleeve structure comprises at least one reinforcement to increase its structural strength.

According to one embodiment, in the lower part of the sleeve structure there is at least one longitudinal metal reinforcement to increase the tensile strength in a lower portion of the binder-stabilization layer.

According to one embodiment, said metal reinforcement is a wire or a rebar.

According to one embodiment, the sleeve structure comprises longitudinal fibre reinforcements, such as fibre wires or braids.

According to one embodiment, said reinforcement is integrated to form an unremovable part of the sleeve structure. The reinforcement may be fixed to the inner surface of the sleeve structure by shape-locking members, adhesive material or support members. The hardenable mixture is arranged to enclose said reinforcements and form a compound structure with the reinforcements.

According to one embodiment, the cross-section of the sleeve structure as seen in a transverse direction of the road comprises at least one profiled portion having a corrugated shape comprising alternating ridges and grooves. The purpose of the profiling is to increase the strength of the structure.

According to one embodiment, the cross-section of the base of the sleeve structure comprises shaped surfaces forming a corrugated profile.

According to one embodiment, the corrugated profile has a serrated profile shaped as a truncated triangle.

According to one embodiment, the corrugated or fluted sleeve structure and the binder-stabilization layer arranged in a space delimited by it are arranged to form a compound structure.

According to one embodiment, the bottom parts of the grooves of the fluted or corrugated profile are provided with tensile reinforcements extending in a longitudinal direction of the road structure. The reinforcements may be for example steel wires, braids or bars. Alternatively, the reinforcements may be plastic or composite ropes.

According to one embodiment the sleeve structure comprises two superposed films extending in a longitudinal direction of the road, the longitudinal edges of which films are closed and between which films a material treated with the hardenable binder is applied. In other words, after fixing the edges the separate films form a tube extending in a longitudinal direction of the road and having a closed cross-sectional shape.

According to one embodiment, the edges of the superposed films are fixed to each other by a welded seam, adhesive material or mechanical fixing member such as a joint strip or staples.

According to one embodiment, the sleeve structure comprises a film extending in a longitudinal direction of the road structure, the longitudinal edges of which film are folded together and fixed to each other, whereby a tubular shape having a closed cross-section is formed.

According to one embodiment, the seam between the longitudinal edges is at the upper surface of the tubular structure. Further, the seam may be on or approximately on the centre axis of the tube.

According to one embodiment, said longitudinal edges are arranged against each other and fixed to each other by a butt scam.

According to one embodiment, said longitudinal edges are arranged so as to overlap and fixed to each other by a lap scam.

According to one embodiment, the edges of the film are fixed to each other by a welded seam, adhesive material or mechanical fixing member such as a joint strip.

According to one embodiment, the sleeve structure is a seamless tube. The tube is a tubular structure which has a closed lateral surface. It may also be referred to as a geotube.

According to one embodiment, the sleeve structure comprises a separate lower film and upper film which delimit together a space for a binder-stabilization layer, and wherein the upper film is arranged to extend wider than the lower film in a transverse direction of the road structure, whereby both longitudinal edges of the upper film comprise wings. In other words, the lower film is shaped to form a base of the space and the upper film is shaped to form a cover which is wider than the lower part. The upper film may protect the structure against moisture from above.

According to one embodiment, said wings are directed obliquely downwards, i.e. they have an oblique angular position. The wings efficiently guide the water and moisture issuing from above away from the structure.

According to one embodiment, the upper surface of the sleeve structure is a flat plane.

According to one embodiment, the upper surface of the sleeve structure is horizontal.

According to one embodiment, the upper surface of the sleeve structure has an angle of inclination against the horizontal direction. Further, the upper surface is arranged to slope towards one edge of the road structure. Thus, the upper surface of the sleeve structure has a so-called gradient towards the edges of the road, whereby the water is guided away from the structure.

According to one alternative embodiment, the cross-section of the upper surface of the sleeve structure is curved as seen in a longitudinal direction of the road and slopes towards both longitudinal edges of the road structure. In other words, the upper surfaces of the sleeve structure and of the binder-stabilized material in a space delimited by it have a convex shape.

According to one embodiment, the curved shape of said upper surface is selected according to the profile of the road being constructed.

According to one embodiment, the sleeve structure and the binder-stabilization layer arranged inside it extends as a unitary structure over the whole width of the road structure, whereby its width corresponds to the width of the road structure.

According to one embodiment, that the road structure comprises at least two binder-stabilization layers arranged inside a sleeve structure.

According to one embodiment, the road structure comprises at least two binder-stabilization layers arranged inside a sleeve structure side by side in a longitudinal direction of the road. Between said elements arranged side by side there may be an expansion joint made from an elastic material. The material of the expansion joint may be for example bitumen, rubber, rubber granules or elastic geopolymer.

According to one embodiment, the road structure comprises at least two binder-stabilization layers arranged inside a sleeve structure in the successive structural layers which are part of the road structure.

According to one embodiment, each longitudinal edge of the road structure comprises a road edge portion. At least one of said edge portions comprises at least one binder-stabilization layer arranged inside a sleeve structure.

According to one embodiment, the binder-stabilization layer arranged inside a sleeve structure is arranged to form at least part of a ditch located in a road edge portion.

According to one embodiment, the binder-stabilization layer arranged inside a sleeve structure is arranged to form a ditch located at the edge of the road structure and part of the road embankment.

According to one embodiment, the sleeve structure or the binder-stabilization layer arranged inside it is provided with at least one cable. The structure provides a good protected place for cables.

According to one embodiment, the structure is provided with one or more data communications cables.

According to one embodiment, the structure is provided with one or more fibre-optic cables or metallic data communications cables.

According to one embodiment, the structure is provided with one or more electric conductors or cables.

According to one embodiment, the structure is provided with a pre-installed electric network or electric circuit.

According to one embodiment, the structure may be pre-equipped with one or more cables which may be put into service sometime later, if necessary. Thereby the structure provides a type of option for later needs.

According to one embodiment, the sleeve structure or the binder-stabilization layer arranged inside it is provided with at least one measuring device. A measuring device, detector or sensor may be arranged to monitor the road structure itself, its surroundings or vehicles travelling on the road.

According to one embodiment, the structure is provided with one or more detectors or sensors for detecting the temperature or a mechanical load.

According to one embodiment, at least one sensor is arranged to detect a vehicle travelling on a section above the road structure. The detection may be based for example on magnetism. The traffic density on the road, speeds of the vehicles, locations of the vehicles may be determined by means of the sensors, and further they may be used for example for the management of road tolls. A corresponding solution may be applied in a foundation of a storage area, airport or terminal, whereby information is also obtained on the movements of work machines and the like.

According to one embodiment, at least one sensor is arranged to observe the road structure, or other foundation, and thereby function as a monitoring device for preventive maintenance.

According to one embodiment, at least one sensor is arranged to measure the weather conditions and send measurement data to the operator of the road network or to a weather service.

According to one embodiment, the binder-stabilization layer arranged in a space delimited by a sleeve structure is electrically conductive and is arranged to function as such as an electrical conductor.

According to one embodiment, the sleeve structure is arranged to function as an electrical insulator around an electrically conductive structure.

According to one embodiment, the binder-stabilization layer may be thoroughly electrically conductive, or alternatively it may have one or more separate limited electrically conductive portions.

According to one embodiment, the binder-stabilization layer arranged in a space delimited by a sleeve structure is electrically conductive and is arranged to function as an electricity storing element.

According to one embodiment, the sleeve structure is arranged to function as an electrical insulator around an electricity storing structure.

According to one embodiment, the binder-stabilization layer may be thoroughly electricity storing, or alternatively it may have one or more separate limited electricity storing portions.

According to one embodiment, the proposed solution relates to an apparatus for treating a structural layer of a road structure. The apparatus is a movable vehicle and it comprises: one or more first feeding devices for feeding one or more film-like sleeve structures to a road structure; one or more second feeding devices for treating soil with a hardenable binder to form a binder-stabilized mass; and one or more third feeding devices for feeding said binder-stabilized mass into a space delimited by the sleeve structure.

According to one embodiment the third feeding device is configured to feed the binder-stabilized mass into a sleeve structure in the movable vehicle of the apparatus. In this case, the binder-stabilized structure is assembled in the vehicle of the apparatus and the ready structure is laid from the vehicle over the road structure or the foundation.

According to one embodiment the third feeding device is configured to feed the binder-stabilized mass over the base part of a sleeve structure that has been arranged over the road structure or the foundation. After that, the first feeding device is configured to feed the cover part of the sleeve structure over the binder-stabilized mass. In this case, the binder-stabilized structure is assembled on the road structure or the foundation by means of the apparatus disclosed in this document.

According to one embodiment the first feeding device may feed a seamless tubular sleeve structure having a closed cross-sectional profile. Alternatively, it may feed one film and may be configured to turn the edges of the film towards each other and fix them to each other. Yet another solution may be that the first feeding device is configured to feed a base film and a surface film and fix them to each other from their longitudinal edges.

According to one embodiment the apparatus further comprises a blade device for removing the soil from the surface of the road structure or the foundation. In this case, the abovementioned second feeding device is configured to treat the removed soil with the binder and said first feeding device is configured to install a sleeve structure and the stabilizing-material treated removed soil back to the surface of the road structure or the foundation.

According to one embodiment, the proposed solution relates to a method for stabilization of a road structure or a foundation. In the method a road structure or a foundation is treated with at least one stabilizing material to improve its compression strength. Further, in the method a stabilized structural layer of the road structure or the foundation is arranged in a space delimited by a sleeve structure.

According to one embodiment, stone material is taken from the existing road structure or foundation and it is treated with a hardenable binder. After that the stabilization-treated stone material is fed into a space delimited by a sleeve structure, whereby it returns back to the road structure or the foundation.

According to one embodiment, the stabilization of the road structure or the foundation is performed without adding new stone material. Thereby transports of stone materials and use of virgin stone material may be avoided.

According to one embodiment, the stabilized structural layer is protected against moisture by means of the sleeve structure.

According to one embodiment, dissolution of materials of the stabilized structural layer and their flowing into the environment are prevented by means of the sleeve structure.

The idea of one embodiment is that in addition to the abovementioned binders, in the proposed solution it is possible to apply all kinds of other available and suitable binders and activating materials by which the geotechnical properties such as, for example, compression strength of the material being treated may be improved.

The idea of one embodiment is that the apparatus comprises an applicator device by which an insulating material may be arranged to the surface of the abovementioned geotube, sleeve structure, earth construction film or fabric. Said insulating material may be for example paint or paint-like material or mass to be applied with a brush, a roller or by spraying and having a good thermal insulation capacity. The material may comprise for example nanomaterial or nanoparticles.

The idea of one embodiment is that the apparatus presented in this document comprises a surfacing device by which a wearing surface layer or a corresponding top surface layer may be arranged directly to the surface of the geotube, sleeve structure or the like. The surfacing may be for example asphalt, concrete or geopolymeric material. The surfacing device may lay the surfacing simultaneously with the abovementioned stabilized structural layer and sleeve structure. Alternatively, the surfacing device may lay the surfacing over the sleeve structure immediately after the sleeve structure with the mass has been supplied out of the apparatus. In both cases the road, foundation of a building or other earth construction site being stabilized is completed in a single operation up to the surface layer.

The idea of one embodiment is that in addition to roads and streets, the proposed foundation, method and the numerous embodiments described above are also applicable to the treatment and improvement of geotechnical properties of the foundation soils for buildings.

The idea of one embodiment is that in addition to roads and streets, the proposed foundation, method and the numerous embodiments described above are also applicable to the treatment of soil foundations of parking spaces, storage spaces, pools, clamps, terminals, sports fields and industrial parks and to the improvement of geotechnical properties of their soils.

The above-disclosed embodiments and their features may be combined to provide desired configurations.

SHORT DESCRIPTION OF THE FIGURES

Figure 2:
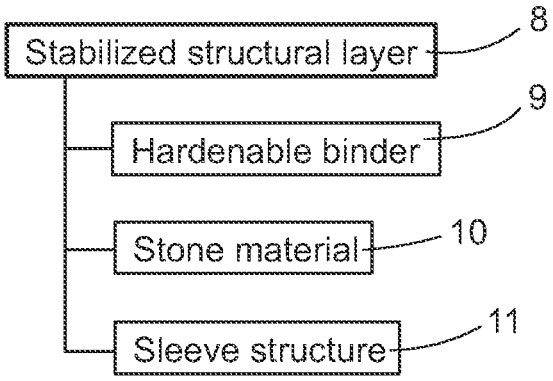
Figure 3:
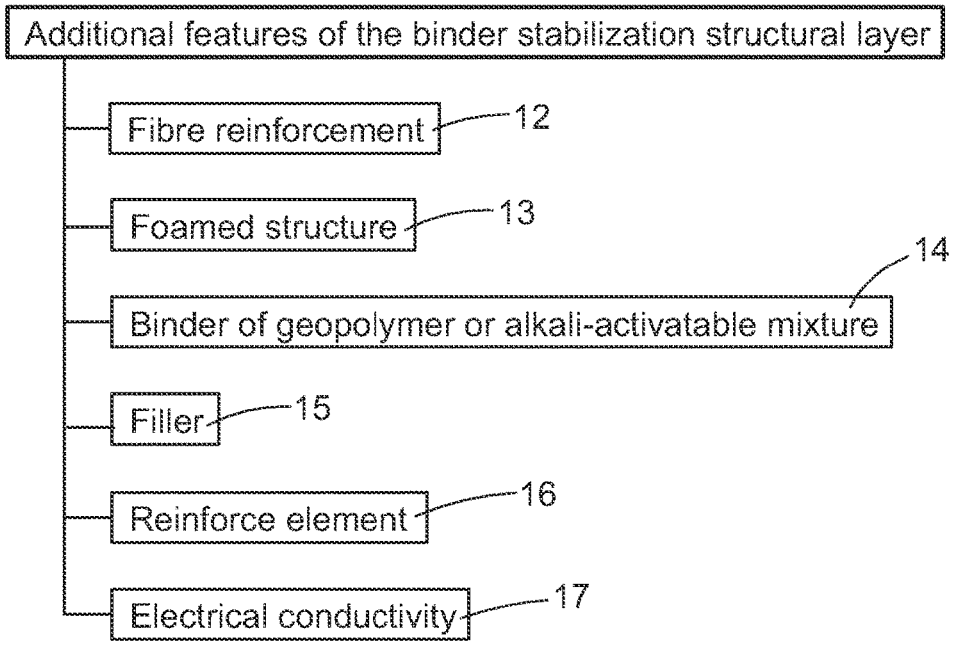
Figure 6:
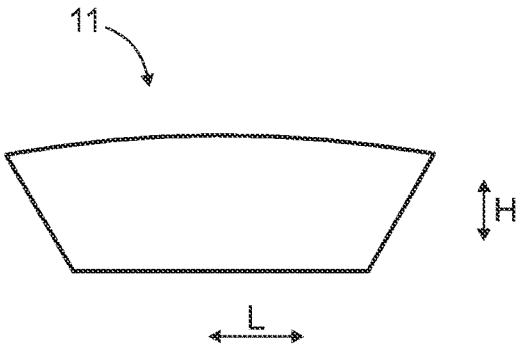
Figure 7:
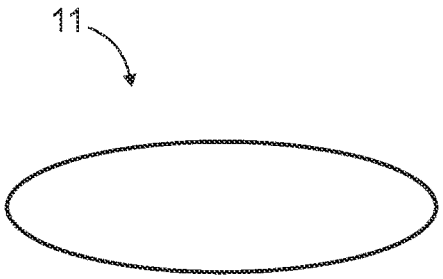
Figure 8:
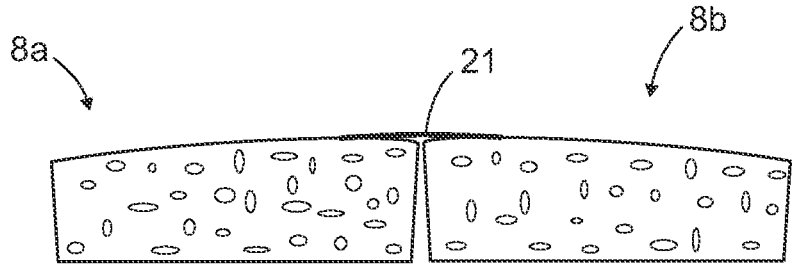
Figure 9:
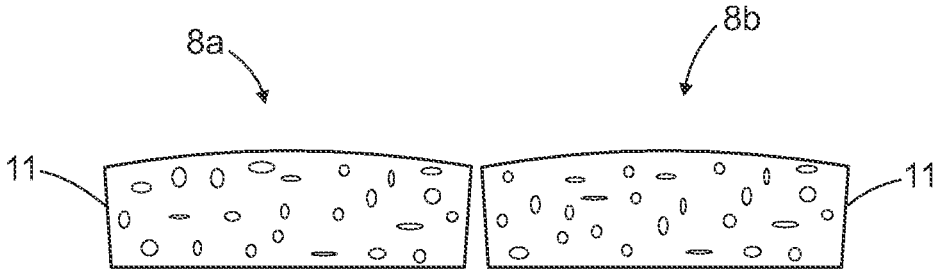
Figure 10:
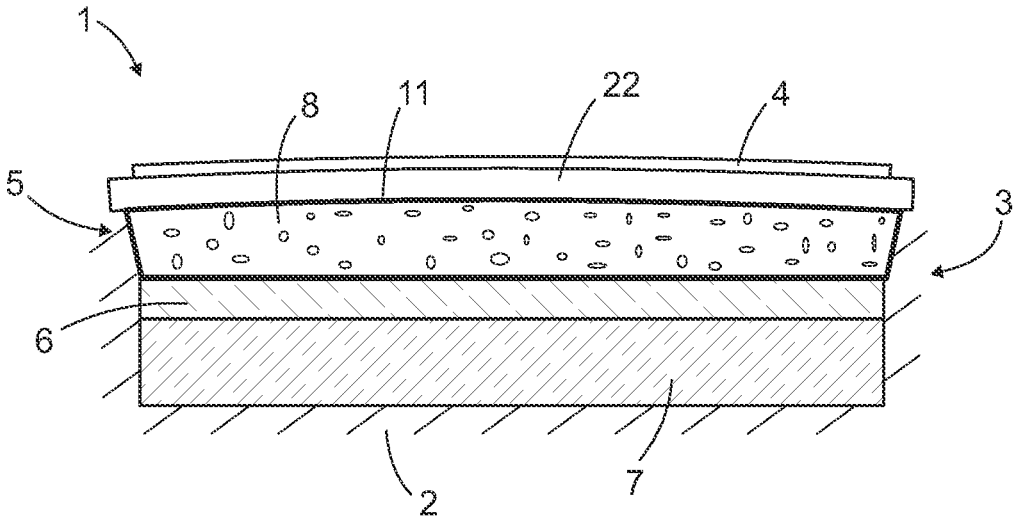
Figure 13:
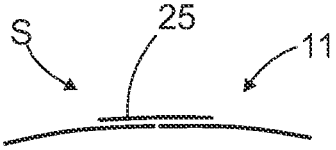
Figure 14:
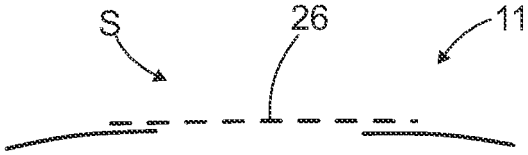
Figure 15:
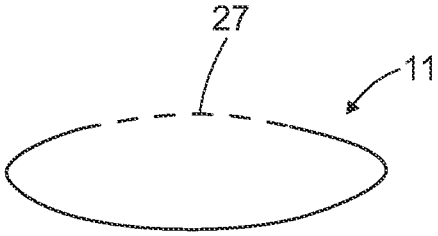
Figure 16:
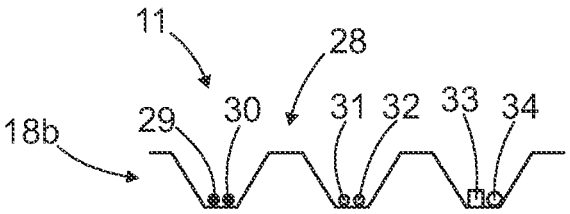
Figure 17:
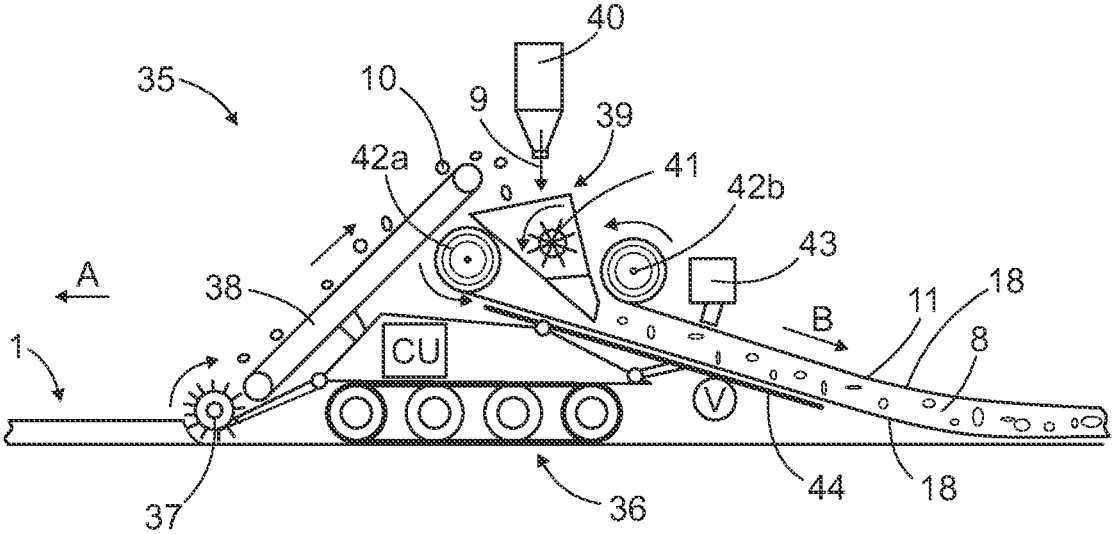
Figure 18:
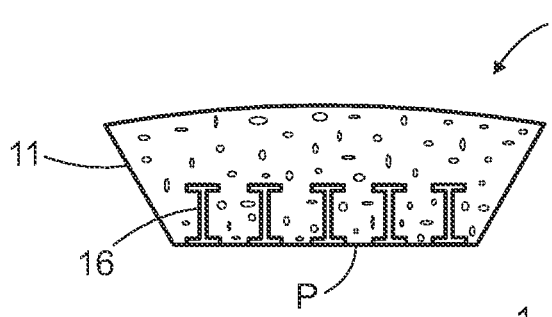
Figure 19:
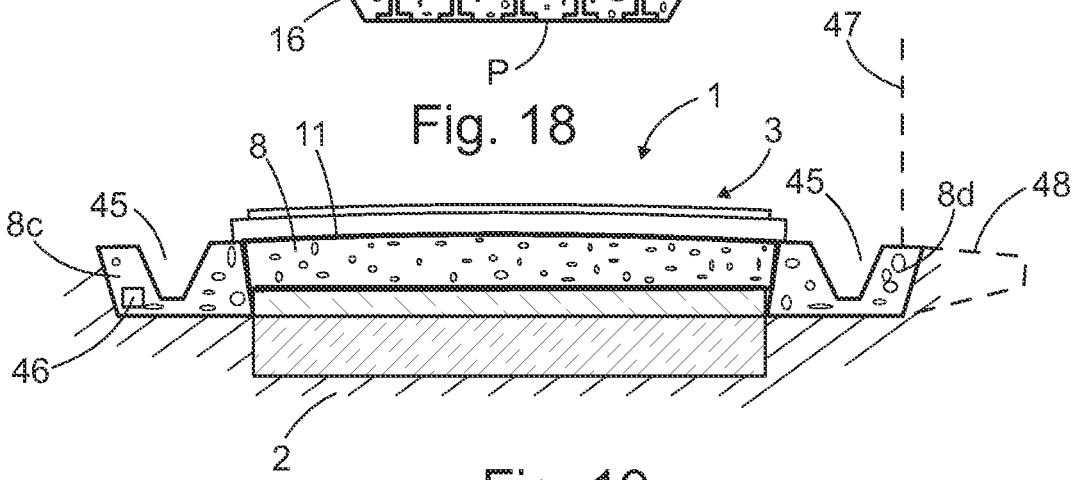
Figure 20:
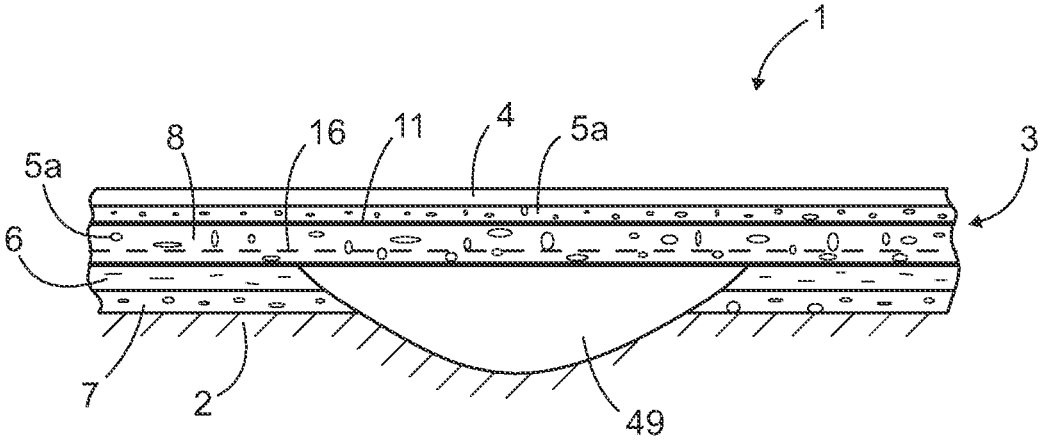

Some embodiments of the proposed solution are illustrated in more detail in the following figures, in which FIG. 1 is a schematical and simplified diagram presenting different layers of a road structure, FIG. 2 is a schematical and simplified diagram presenting a composition of one binder-stabilized structural layer, FIG. 3 is a schematical and simplified diagram presenting some additional features and components which may be included in a stabilized structural layer, FIGS. 4-7 schematically illustrate some possible profiles and structures of sleeve structures, FIGS. 8 and 9 illustrate sleeve structures arranged in a longitudinal direction next to each other over part of a wider road structure, FIG. 10 schematically illustrates a cross-section of one road structure as seen from a longitudinal direction of the road, FIGS. 11-14 schematically illustrate some seam structures of a sleeve structure, FIG. 15 schematically illustrates one sleeve structure comprising a gas-permeable portion, FIG. 16 schematically illustrates a detail of one sleeve structure comprising a corrugated base profile, FIG. 17 schematically illustrates one apparatus for stabilizing a road structure or a foundation by means of a binder and a sleeve structure, FIG. 18 schematically illustrates one sleeve structure which encloses a binder-stabilized mass and inside which there are stiffeners as seen in a longitudinal direction, FIG. 19 schematically illustrates one road structure, the edges of which comprise binder-stabilized edge parts arranged inside a sleeve structure, as seen in a longitudinal direction, and FIG. 20 schematically illustrates a road structure with a lightening structure passing over a depression in the roadbed as seen in a transverse direction.

For clarity reasons, some embodiments of the proposed solutions are illustrated in the figures in a simplified form. The same reference numbers are used in the figures to refer to the same elements and features.

DETAILED DESCRIPTION OF SOME EMBODIMENTS

As seen in FIG. 1, a road structure 1 typically comprises a subsoil 2 over which a pavement structure 3 of the road is provided. The pavement structure 3 comprises a plurality of successive layers which may include a surface layer 4, a base layer 5, a sub-base layer 6 and a drainage layer 7. There may be more or fewer of the structural layers depending on the circumstances. The structural layers may be as known per se in structure and properties. One or more of these structural layers may be treated with a hardenable binder and arranged inside a sleeve structure to stabilize the structural layer.

In FIG. 2 it is presented that a stabilized structural layer 8 comprises a hardenable binder 9 by which the stone material 10 of the structural layer 8 is reinforced. The stone material 10 may be for example sand, gravel, broken stone, crushed material or the like. The stabilized material or mass is further applied in a space delimited by a sleeve structure 11. The sleeve structure 11 may be as described in this document.

FIG. 3 lists additional features which may be included in a binder-stabilized structural layer. As mentioned above in this document, the mass applied inside a sleeve structure may comprise a fibre reinforcement 12 and the mass may be foamed 13. Further, for example a geopolymer or an alkali-activatable mixture 14 may be used for the stabilization of the stone material. Additionally, a filler 15 may be mixed in the mass and its strength may be improved by using separate stiffener elements 16. The mass may be electricity-conducting 17 and storing.

Figure 4:
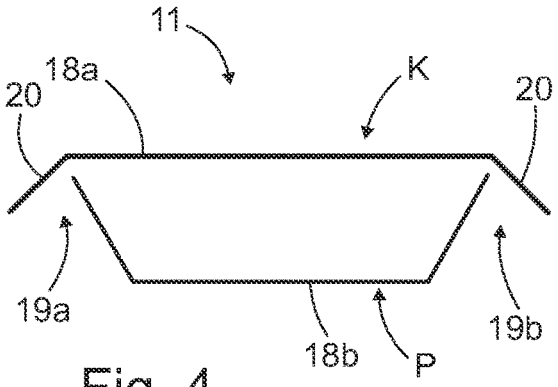
Figure 5:
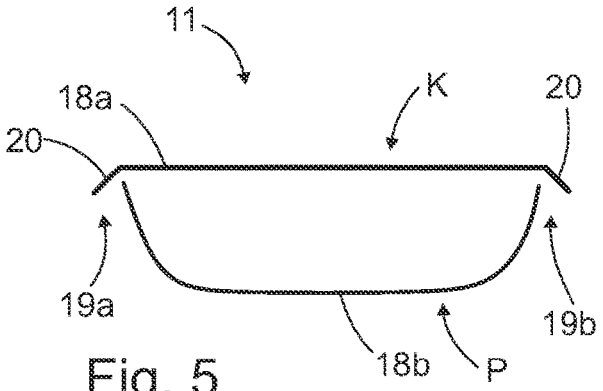

The sleeve structures 11 illustrated in FIGS. 4 and 5 each comprise two superposed films 18*a*, 18*b* extending in a longitudinal direction of the road, the longitudinal edges 19*a*, 19*b* of which films are closed and between which films the material treated with a hardenable binder is applied. Thereby, after fixing the edges the films 18*a*, 18*b* form a tube having a closed cross-sectional shape.

On the other hand, it is also possible that the edges 19*a*, 19*b* are not fixed to each other, but the films 18*a*, 18*b* are overlapped with each other, or alternatively the edges of the films are folded in such a way that a desired structure can be formed.

In FIGS. 4 and 5 the upper film 18*a* forms a cover K and the lower film 18*b* forms a base P. The upper film 18*a* is arranged to extend wider than the lower film 18*b* in a transverse direction of the road structure, whereby both longitudinal edges of the upper film 18*a* comprise wings 20. The cover K is thus wider than the base P, whereby the downwardly oblique wings 20 may guide water away from the road structure. The length of the wings 20 may be selected as desired.

FIGS. 6 and 7 illustrate tubular-shaped sleeve structures 11 that may comprise one or more seams or they may have a seamless structure. As shown, the cross-sectional shape of the sleeve structure 11 may be selected on a case-by-case basis. The cross-section may be angular, have curved shapes or their combination. Further, the width L of the sleeve structure may be selected according to the width of the driveway of the road and it may comprise one driveway or two driveways. The height H may be selected on a case-by-case basis.

In FIG. 8, two stabilized structural layers 8*a*, 8*b* inside a sleeve structure 11 are arranged next to each other in a longitudinal direction of the road, whereby a wider road may be covered. As shown, the shape of the structural layers may be asymmetrical, i.e. they may be thicker in the middle than at the edges, whereby a curved surface can be easily formed at the upper surface of the road, which curved surface has a gradient towards the edges. A joint strip 21 or a corresponding element may be arranged at a longitudinal seam between the structural layers 8*a* and 8*b*. It is clear that there may also be more than two structural layers arranged side by side. Thus, a bicycle driveway may be formed at the edge of a vehicle driveway by means of a third structural layer, or an overtaking lane, bus stop or other widening may be provided at a desired location of the road.

In FIG. 9, identical stabilized structural layers 8*a*, 8*b* are arranged next to each other. The seam may be filled by means of stone material to be applied above or for example with bitumen or some other elastic mass.

FIG. 10 illustrates one road structure 1 in which a binder-stabilized structural layer 8 is the base layer 5 over which a levelling layer 22 is further arranged. The levelling layer 22 may be a protective layer or a layer that enables shaping of the road surface and protects the sleeve structure 11. The levelling layer 22 may be crushed material. On top there is a surface layer 4 which may be crushed material, oil gravel, concrete or asphalt. Under the structural layer 8 enclosed within the sleeve structure 11 there may be the normal sub-base layer 6 and drainage layer 7 which are part of the pavement structure 3 and of course the subsoil 2 under the pavement structure 3.

Figure 11:
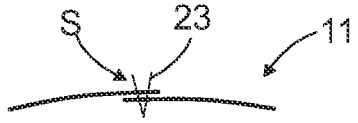

FIG. 11 illustrates a seam S of a sleeve structure 11, which is a lap seam. The lap seam may comprise a welded joint 23 or alternatively the seam S may be fixed with glue or the like.

Figure 12:
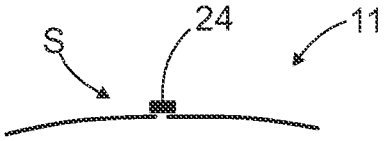

The seam S illustrated in FIG. 12 is a butt seam that may be strengthened by means of adhesive material or mass 24.

In FIG. 13, the seam S is also a butt seam, but this time the seam S is strengthened by means of a joint strip 25.

In FIG. 14, a gas-permeable strip 26 or portion is arranged in a seam area S. The strip 26 may be such that it prevents the access of liquid through the strip but allows a gas to pass through.

FIG. 15 illustrates a sleeve structure 11, the structure of which comprises a gas-permeable portion 27. The portion 27 may be in the upper portion of the sleeve 11, whereby the gases naturally pass out from the structure through the portion. The material in this portion 27 may be such that it prevents the access of liquid through the material but allows a gas to pass through. The shape of the sleeve structure 11 may of course be any type of shape when applying this feature.

As illustrated in FIG. 16, the base 18*b*, or some other portion, of the sleeve structure 11 may comprise a profiled portion 28 that may have a corrugated shape. The corrugation may be angular or of a curved shape. Bar-type stiffeners 29 or ropes 30 may be provided in connection with the corrugated profile on the inner surface of the sleeve structure 11. Further, the sleeve structure 11 may comprise electric conductors 31 and data communications cables 32. Additionally, the sleeve structure 11 may be equipped for example with power sensors 33 and cables 34 monitoring the temperature. Said equipment 29-34 may also be located in other places in addition to the base of the corrugated profile.

FIG. 17 illustrates an apparatus 35 for treating a structural layer of a road structure 1. The apparatus comprises a movable vehicle 36 having a blade device 37 for removing the soil from the surface of the road structure 1 while the apparatus 35 is being moved in a driving direction A. The blade device 37 may be for example a milling machine. The removed stone material, or for instance old asphalt, is conveyed by a conveyor 38 to a feeding device 39 in which a binder is mixed into the material from a container 40 for stabilizing it. The feeding device 39 comprises a mixer 41 in which a hardenable mass is formed. There may of course be several containers 40, if several components are used in the stabilization. The resulting mass is fed between two films. The film may be fed from feeding rollers 42*a*, 42*b*. The edges of the films may be connected by means of a seaming device 43. Alternatively, only one film is fed from one feeding roller 42*a* and its edges are turned up by means of guide members and finally in a tubular manner to the upper surface at which the seam may be fixed by means of the seaming device 43. The formed tubular sleeve structure 11 and the stabilized mass inside the structure are fed as a continuous structural layer 8 along an inclined feeding surface 44 to the back side of the apparatus 35. The apparatus 35 is thus able to produce the structural layer 8 in a continuous process at the same time as it moves in the direction A. The apparatus 35 lays the geotube from its rear end in a direction B. The feeding surface 44 may be a planar surface, or it may comprise rollers or other rolling elements. Further, in connection with the feeding surface there may be a vibrator V, whereby the binder-stabilized mass will be compacted as it passes from the apparatus 35 to the road foundation.

FIG. 18 illustrates one structural layer 8 in which a sleeve structure 11 encloses a binder-stabilized mass and inside which stiffeners 16 are provided. The stiffeners may be fixed to the base P of the sleeve structure 11, which base is subject to tensile stress during use due to bending. The stiffeners may have for example an I-profile and they may be metal, plastic material or composite material.

FIG. 19 illustrates one road structure 1 having a binder-stabilized structural layer 8 enclosed within a sleeve structure 11 in its pavement structure 3. Additionally, the edges of the road structure 1 also comprise binder-stabilized edge parts 8*c*. 8*d* arranged inside a sleeve structure 11. These edge parts 8*c*. 8*d* may form the embankment or shoulder of the road structure and may thereby speed up the construction of the road and facilitate road maintenance. Further, the edge parts 8*c*, 8*d* may be provided with a ready ditch profile 45, technical installations 46 or supports 47. The technical installations 46 may be for example conductors, measuring devices and fixing elements. The supports 47 may be for example elements intended for supporting and fixing railings, lampposts, traffic signs and the like. Further, the edge parts 8*c*, 8*d* may comprise integrated or separate extension parts 8*e* which also comprise a binder-stabilized structure enclosed within a sleeve structure. The counter embankment of the road structure may be supported and construction of the road speeded up by means of the extension part. Further, maintenance of the road may be facilitated and safety improved when vegetation at the edges of the road may be prevented.

FIG. 20 illustrates the use of a binder-stabilized structural layer 8 arranged inside a sleeve structure 11 in passing over a depression 49, dip, furrow or the like. The stabilized structural layer 8 is part of the base layer 5*a*, 5*b* of the pavement structure 3 and it may comprise longitudinal stiffeners 16. The mass inside the sleeve structure 11 may be foamed, whereby the thickness of the structural layer 8 may be high without the risk that its own mass increases too much. The structural layer 8 may thus be a lightening structure by means of which the construction of the road may be significantly speeded up and transport of filler soil saved.

The solution is presented in the figures in connection with a road structure, which is one significant application of the solution. In addition to that, the features and details described above may be used in the foundations of different fields and storage areas. In this case a plurality of foundation elements formed by a sleeve structure and a binder-stabilized mass may be arranged side by side. The seams may be protected with separate protective films or membranes. A surface layer may be applied to the surface, which surface layer protects the structure and gives the intended properties for the structure.

The proposed solution is also applicable to the stabilization of subsoils and foundations of halls and large buildings. Further, also the foundations of different pools and clamps may be stabilized as presented in this document.

The figures and their description are only intended to illustrate the idea of the invention. However, the scope of protection of the invention is defined in the claims of the application.

The invention claimed is:

1. A foundation, comprising:

a subsoil;

a pavement structure formed over the subsoil and comprising a plurality of successive structural layers;

and wherein at least one of said structural layers is stabilized by means of at least one hardenable binder and forms a binder-stabilization layer;

and further, wherein at least one of said binder-stabilization layers of the pavement structure is enclosed within a sleeve structure, the sleeve structure comprises two superposed films extending in a longitudinal direction of the foundation, the longitudinal edges of which films are closed and between which films the material treated with a hardenable binder is arranged;

wherein the binder-stabilization layer arranged inside the sleeve structure is of a geopolymer or an alkali-activatable hardenable mixture;

and wherein the compression strength of the binder-stabilization layer arranged inside the sleeve structure is at least 0.1 Mpa.

2. The foundation according to claim 1, wherein:

the binder-stabilization layer arranged inside the sleeve structure comprises stone material and at least one hardenable binder.

3. The foundation according to claim 1, wherein:

the binder-stabilization layer arranged inside the sleeve structure comprises at least one fibre reinforcement.

4. The foundation according to claim 1, wherein the binder-stabilization layer arranged inside the sleeve structure is foamed.

5. The foundation according to claim 1, wherein the binder-stabilization layer arranged inside the sleeve structure further comprises at least one filler which is non-stone material.

6. The foundation according to claim 1, wherein the binder-stabilization layer arranged inside the sleeve structure further comprises at least one stiffener element.

7. The foundation according to claim 1, wherein the sleeve structure is flexible film-like material.

8. The foundation according to claim 1, wherein the sleeve structure is impermeable to liquid and solid material.

9. The foundation according to claim 1, wherein the sleeve structure comprises at least one reinforcement.

10. The foundation according to claim 1, wherein a cross-section of the sleeve structure as seen in a transverse direction of the foundation comprises at least one profiled portion which has a corrugated shape comprising alternating ridges and grooves.

11. The foundation according to claim 1, wherein the sleeve structure comprises a film extending in the longitudinal direction of the foundation, longitudinal edges of which film are folded together and fixed to each other, whereby a tubular shape having a closed cross-section is formed.

12. The foundation according to claim 1, wherein the sleeve structure is a seamless tube.

13. The foundation according to claim 1, wherein the sleeve structure comprises a separate lower film and upper film which delimit together a space for the binder-stabilization layer, and wherein the upper film is arranged to extend wider than the lower film in a transverse direction of the foundation, whereby both longitudinal edges of the upper film comprise wings.

14. The foundation according to claim 10, wherein an upper surface of the sleeve structure is a flat plane.

15. The foundation according to claim 14, wherein the cross-section of the upper surface of the sleeve structure is curved as seen in a longitudinal direction of the foundation and slopes towards both longitudinal edges of the foundation.

16. The foundation according to claim 1, wherein the sleeve structure and the binder-stabilization layer arranged inside it extends as a unitary structure over the whole width of the foundation, whereby its width corresponds to the width of the foundation.

17. The foundation according to claim 1, wherein the foundation comprises at least two binder-stabilization layers arranged inside a sleeve structure.

18. The foundation according to claim 1, wherein the foundation is a road structure; and each longitudinal edge of the road structure comprises a road edge portion and that at least one edge portion comprises at least one binder-stabilization layer arranged inside the sleeve structure.

19. The foundation according to claim 1, wherein the sleeve structure or the binder-stabilization layer arranged inside it is provided with at least one cable.

20. The foundation according to claim 1, wherein the sleeve structure or the binder-stabilization layer arranged inside it is provided with at least one measuring device.

21. The foundation according to claim 1, wherein the binder-stabilization layer arranged in a space delimited by the sleeve structure is electrically conductive and is arranged to function as such as an electrical conductor.

22. The foundation according to claim 1, wherein the binder-stabilization layer arranged in a space delimited by the sleeve structure is electrically conductive and is arranged to function as an electricity storing element.

23. A method for stabilization of a foundation, in which method the foundation is treated with at least one stabilizing material to improve its compression strength; and a stabilized structural layer of the foundation is arranged in a space delimited by a sleeve structure; wherein a geopolymer or an alkali-activatable mixture is used for stabilizing stone material, and wherein stone material is taken from the foundation;

the stone material is treated with a hardenable binder;

the stabilization-treated stone material is fed into a space delimited by a sleeve structure; and the taken stone material is returned back to the foundation after the treatment.

24. The method according to claim 23, wherein the stabilization is performed without adding new stone material.

25. The method according to claim 23, wherein the stabilized structural layer is protected against moisture by means of the sleeve structure.

26. The method according to claim 23, wherein dissolution of materials of the stabilized structural layer and their flowing into the environment are prevented by means of the sleeve structure.

27. A foundation, comprising:

a subsoil;

a pavement structure formed over the subsoil and comprising a plurality of successive structural layers;

and wherein at least one of said structural layers is stabilized by means of at least one hardenable binder and forms a binder-stabilization layer;

and further, wherein at least one of said binder-stabilization layers of the pavement structure is enclosed within a sleeve structure, and wherein the sleeve structure comprises a film extending in the longitudinal direction of the foundation, longitudinal edges of which film are folded together and fixed to each other, whereby a tubular shape having a closed cross-section is formed; wherein the binder-stabilization layer arranged inside the sleeve structure is of a geopolymer or an alkali-activatable hardenable mixture;

and wherein the compression strength of the binder-stabilization layer arranged inside the sleeve structure is at least 0.1 Mpa.

* * * * *